US007048597B2

(12) United States Patent
Chen

(10) Patent No.: US 7,048,597 B2
(45) Date of Patent: May 23, 2006

(54) FEMALE TERMINAL FOR HEAVY CURRENT AND FEMALE TERMINAL FOR HEAVY CURRENT WITH SHELL

(75) Inventor: Ping Chen, West Bloomfield, MI (US)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/996,498

(22) Filed: Nov. 23, 2004

(65) Prior Publication Data

US 2005/0118891 A1 Jun. 2, 2005

(30) Foreign Application Priority Data

Nov. 28, 2003 (JP) ..... 2003-400092

(51) Int. Cl.
*H01R 11/22* (2006.01)

(52) U.S. Cl. ..... 439/851; 439/856

(58) Field of Classification Search ..... 439/851, 439/856

See application file for complete search history.

(56) References Cited

U.S. PATENT DOCUMENTS 5,437,566 A * 8/1995 Zinn et al. ..... 439/839

6,394,858 B1 * 5/2002 Geltsch et al. ..... 439/852

FOREIGN PATENT DOCUMENTS

| | | |
|---|---|---|
| JP | 09-082391 | 3/1997 |
| JP | 09-134751 | 5/1997 |
| JP | 10-116644 | 5/1998 |
| JP | 10-294143 | 11/1998 |
| JP | 11-067310 | 3/1999 |

* cited by examiner

*Primary Examiner*—Truc Nguyen
(74) *Attorney, Agent, or Firm*—W. F. Fasse; W. G. Fasse

(57) ABSTRACT

A female terminal for heavy current reduces the contact resistance relative to a male terminal, and correctly positions the male terminal's blade. The body part of the female terminal includes a first elastic piece, provided at least on one side in the height direction of a receiving space so that it can undergo elastic deformation in the height direction, and having, on the inner side thereof, a first contacting part extending for a certain width. The body part further includes a second elastic piece, provided at least on one side in the width direction of the receiving space so that it can undergo elastic deformation in the width direction, and having, on the inner side thereof, a second contacting part extending for a certain height. When the blade is inserted into the receiving space, the first contacting part pressingly contacts a top or bottom face of the blade and the second contacting part pressingly contacts a side face of the blade.

27 Claims, 12 Drawing Sheets

FEMALE TERMINAL FOR HEAVY CURRENT AND FEMALE TERMINAL FOR HEAVY CURRENT WITH SHELL

BACKGROUND OF THE INVENTION

1. Field of the Invention

The present invention belongs to the field of female terminals, and relates to a female terminal for heavy current into which and from which a blade of a blade-type male terminal having a substantially plate-shaped blade is inserted and withdrawn.

2. Related Art

Japanese Patent Unexamined Publication Heisei 10-116644 discloses a female terminal for heavy current having a tubular contacting part for a terminal pin of a male terminal to be inserted, wherein a ring-shaped thin wall part is provided on the outer circumference on the terminal pin insertion end side of said tubular contacting part, said thin wall part being provided with a plurality of projections projecting from the inner face of the tubular contacting part at appropriate intervals.

Japanese Patent Unexamined Publication Heisei 11-67310 discloses a terminal for heavy current charging, comprising a female terminal having an insertion hole for a rod-shaped male terminal to be inserted and having a large-diameter receiving part being formed continuously on the opening side of the insertion hole, a contacting spring member having a large number of arched leaf spring pieces interconnected together on only one side thereof and being formed into an approximately cylindrical form corresponding to the outer diameter of said male terminal and the inner diameter of the insertion hole of said female terminal and a fixing rib being formed on the interconnected side of said leaf spring pieces to protrude in a direction perpendicular to the leaf spring pieces and contact the rear wall of the receiving part of said female terminal, and a cap having a through hole for said male terminal to be inserted, being fitted on the receiving part of said female terminal, gripping the fixing rib of said contacting spring member to fix said contacting spring member in the insertion hole of said female terminal.

SUMMARY OF THE INVENTION

The female terminal for heavy current of Japanese Patent Unexamined Publication Heisei 10-116644 provides stable contact resistance, but as the projections make point contact with the pin of the male terminal, the contact area between the projections and the pin is small and the contact resistance cannot be reduced sufficiently.

In the terminal for heavy current charging of Japanese Patent Unexamined Publication Heisei 11-67310, the leaf spring pieces of the contacting spring member are arranged to form an approximately cylindrical form corresponding to both the outer diameter of the male terminal and the inner diameter of the insertion hole of the female terminal, and the respective leaf spring pieces and the male terminal make point contact and the contact area is small, hence the contact resistance cannot be reduced sufficiently.

The present invention was made in view of these points, and its object is to provide a female terminal for heavy current into which and from which a blade of a blade-type male terminal is inserted and withdrawn, wherein a plurality of points for contacting with the blade are provided, the contact area of each contact point is made larger and the contact pressure is made higher so as to reliably reduce the contact resistance between the female terminal and the male terminal, allows stable flow of heavy current between both terminals at low loss and correctly positions the blade with respect to the body part.

To accomplish the above-mentioned object, the female terminal for heavy current of the present invention is a female terminal for heavy current, with reference to a depth direction, a width direction and a height direction being perpendicular to each other, into which is inserted and from which is withdrawn a blade of a blade-type male terminal. The blade is substantially plate-shaped, has a width greater than the height, and extends frontward in the depth direction. This female terminal for heavy current comprises a body part having a tubular form extending in the depth direction and being provided therein with a receiving space for receiving the blade from the rear side, and a connecting part provided on the front in the depth direction of the body part and being adapted to be connected with a conductor. The body part has a first elastic piece being provided at least one side in the height direction of the receiving space in such a way that the first elastic piece can undergo elastic deformation in the height direction and being provided, on the inner face thereof, with a contacting part extending for a certain width. The body part further has a second elastic piece being provided at least on one side in the width direction of the receiving space in such a way that the second elastic piece can undergo elastic deformation in the width direction and being provided, on the inner face thereof, with a contacting part extending for a certain height. The female terminal for heavy current is so structured that upon insertion of the blade into the receiving space the contacting part of the first elastic piece will contact, with a contact pressure, one end face in the height direction of the blade and the contacting part of the second elastic piece will contact, with a contact pressure, one end face in the width direction of the blade.

When the blade is inserted into the receiving space, the contacting part of the first elastic piece will contact, with a contact pressure, one end face in the height direction of the blade and a part of the body part facing the receiving space will contact, with a contact pressure, the other end face in the height direction of the blade. On the other hand, the contacting part of the second elastic piece will contact, with a contact pressure, one end face in the width direction of the blade and a part of the body part facing the receiving space will contact, with a contact pressure, the other end face in the width direction of the blade. In that case, the female terminal for heavy current will contact the blade at a plurality of points including the contacting part of the first elastic piece and the contacting part of the second elastic piece. Moreover, as these contacting parts contact the blade by line contact or surface contact rather than point contact, a larger contact area is obtained. Furthermore, due to the elastic restoring forces of the elastic pieces, higher contact pressures are obtained at the contacting parts. Accordingly, the contact resistances between the female terminal and the male terminal are reduced reliably, and heavy current will flow stably at a lower loss between both the terminals. Moreover, as the blade is held by both the first elastic piece and the part of the body part facing the receiving space and the blade is held by both the second elastic piece and the part of the body part facing the receiving space, positioning of the blade in the body part is done accurately.

Accordingly, in the female terminal for heavy current of the present invention, a plurality of contacting points for the blade can be provided, the contact areas of the respective contacting points can be increased, and the contact pressures can be increased, hence the contact resistance between it and the male terminal can be reduced reliably, heavy current can be passed between both the terminals at a lower loss stably, and positioning of the blade in the body part can be done accurately.

The female terminal for heavy current of the present invention may be so structured that the body part is provided with a cross wall on the other side in the height direction of the receiving space, said cross wall being provided, on the inner face thereof, with a contacting part extending for a certain width, and upon insertion of the blade into the receiving space, the contacting part of the cross wall will contact, with a contact pressure, the other end face in the height direction of the blade.

With this arrangement, when the blade is inserted into the receiving space, the contacting part of the first elastic piece will contact, with a contact pressure, one end face in the height direction of the blade, and the contacting part of the cross wall of the body part will contact, with a contact pressure, the other end face in the height direction of the blade.

Accordingly, as the first elastic piece is provided on only one side in the height direction of the receiving space, the structure is relatively simple.

The female terminal for heavy current of the present invention may be so structured that the body part has another first elastic piece being provided on the other side in the height direction of the receiving space in such a way that the first elastic piece can undergo elastic deformation in the height direction and being provided, on the inner face thereof, with a contacting part extending for a certain width, and upon insertion of the blade into the receiving space the contacting part of the first elastic piece will contact, with a contact pressure, the other end face in the height direction of the blade.

With this arrangement, when the blade is inserted into the receiving space, the contacting parts of the first elastic pieces will contact, with a contact pressure, both the end faces in the height direction of the blade.

Accordingly, as the first elastic pieces are provided on both sides in the height direction of the receiving space, the amounts of elastic deformation of the first elastic pieces can be kept relatively low.

The female terminal for heavy current of the present invention may be so structured that the body part is provided with a vertical wall on the other side in the width direction of the receiving space, said vertical wall being provided, on the inner face thereof, with a contacting part extending for a certain height, and upon insertion of the blade into the receiving space, the contacting part of the vertical wall will contact, with a contact pressure, the other end face in the width direction of the blade.

With this arrangement, when the blade is inserted into the receiving space, the contacting part of the second elastic piece will contact, with a contact pressure, one end face in the width direction of the blade and the contacting part of the vertical wall of the body part will contact, with a contact pressure, the other end face in the width direction of the blade.

Accordingly, as the second elastic piece is provided only on one side in the width direction of the receiving space, the structure is relatively simple.

The female terminal for heavy current of the present invention may be so structured that the body part has another second elastic piece being provided on the other side in the width direction of the receiving space in such a way that the second elastic piece can undergo elastic deformation in the width direction and being provided, on the inner face thereof, with a contacting part extending for a certain height, and upon insertion of the blade into the receiving space, the contacting part of the second elastic piece will contact, with a contact pressure, the other end face in the width direction of the blade.

With this arrangement, when the blade is inserted into the receiving space, the contacting parts of the second elastic pieces will contact, with a contact pressure, both end faces in the width direction of the blade.

Accordingly, as the second elastic pieces are provided on both sides in the width direction of the receiving space, the amounts of elastic deformation of the second elastic pieces can be kept relatively low.

The female terminal for heavy current of the present invention may be so structured that the body part is divided into a rear end part being located at the rear end in the depth direction and a front end part being located at the front end, rear-end-part-constituting walls constituting the rear end part and front-end-part-constituting walls constituting the front end part are interconnected to each other by the first elastic piece, the second elastic piece or both the elastic pieces, and the elastic piece interconnecting both the rear-end-part-constituting walls and the front-end-part-constituting walls is so bent that an intermediate part thereof gets closer toward the receiving space, and the contacting part is provided on the bending part.

With this arrangement, as the elastic piece is supported on both ends by the front end part and the rear end part of the body part, the contact pressure that can be obtained at the contacting part is higher in comparison with, for example, a cantilever elastic piece that is supported on only one end by the main body, assuming the lengths in the depth direction of the elastic pieces are substantially equal. Moreover, as the rear-end-part-constituting walls, the first elastic piece, the second elastic piece or both the elastic pieces and the front-end-part-constituting walls are continuous without any break, insertion and withdrawal of the blade is done smoothly without any hitch. Furthermore, as there is no constituting wall of the body part on the outer side of the first elastic piece, the second elastic piece or both the elastic pieces, the height or the width or both the height and width of the female terminal for heavy current can be reduced.

Accordingly, as the rear-end-part-constituting walls and the front-end-part-constituting walls are interconnected by the first elastic piece, the second elastic piece or both the elastic pieces, the contact pressure that is obtained at the contacting part is higher when the elastic piece is supported on both ends by the main body, insertion and withdrawal of the blade can be done smoothly without any hitch, and the height or the width or both the height and width of the female terminal for heavy current can be reduced.

The female terminal for heavy current of the present invention may be so structured that a plurality of the first elastic pieces are arranged side by side in the width direction.

With this arrangement, even if an end face in the height direction of the blade slants a little in the width direction, the contacting parts of the plurality of the first elastic pieces follow this slant and contact well the end face of the blade respectively.

Accordingly, even if an end face in the height direction of the blade slants a little in the width direction, the contacting parts of a plurality of the first elastic pieces will follow the slant and contact well the end face of the blade respectively, thus the contact state is stabilized.

A female terminal for heavy current with a shell of the present invention comprises the female terminal for heavy current of the present invention and a tubular shell that extends in the depth direction and fits with the body part of the female terminal for heavy current from outside.

This female terminal for heavy current with a shell provides effects that are similar to the effects that are provided by the female terminal for heavy current of the present invention. This female terminal for heavy current with a shell contacts a blade with a large contact area as well as a high contact pressure. In that case, as the deformation of the female terminal for heavy current is restrained by the shell, the contacting pieces exhibit predetermined functions and the contacting parts contact, with a high contact pressure, the blade. When the elastic pieces are deformed excessively, the shell will restrain them to prevent the elastic pieces from undergoing plastic deformation and breaking. Moreover, the shell protects the elastic pieces therein from external forces. If the shell is provided with, for example, a projecting piece rising outward and a housing is provided with a receiving chamber for receiving the female terminal for heavy current with a shell and a guiding groove for guiding the projecting piece, at the time of inserting the female terminal for heavy current with a shell into the housing, functions of preventing reverse insertion wherein it is inserted in a wrong orientation in the height direction or the depth direction into the housing and incorrect insertion wherein it is inserted into a housing that is not a genuine counterpart member are exhibited.

Accordingly, the female terminal for heavy current with a shell of the present invention provides effects that are similar to those obtained from the female terminal for heavy current of the present invention. Moreover, as deformation of the female terminal for heavy current is restrained by the shell, the contacting pieces exhibit predetermined functions and the contacting parts contact the blade with a high contact pressure. Furthermore, when the elastic pieces undergo excessive deformation, the shell will restrain such deformation to prevent the elastic pieces from plastic deformation and breakage. The shell protects the elastic pieces therein from external forces. It is also possible to make the female terminal for heavy current with a shell of the present invention exhibit the functions of preventing reverse insertion and incorrect insertion, and when such functions are required, such requirements can be met by designing or selecting a shell that fits with the female terminal for heavy current without any design change of the female terminal for heavy current.

PREFERRED EMBODIMENT OF THE INVENTION

In the following, some embodiments of the present invention will be described. FIG. 1 through FIG. 12 show the female terminal for heavy current 100 of the first embodiment of the present invention. A depth direction, a width direction and a height direction all being perpendicular to each other are assumed, and these directions are used for the description. In the case of this embodiment, with reference to FIG. 3, the left-right direction of the diagram is the depth direction, the left of the diagram is the rear in the depth direction, and the right is the front in the depth direction. The direction perpendicular to the plane of the paper of the diagram is the height direction, and the top-bottom direction of the diagram is the width direction.

Figure 1:
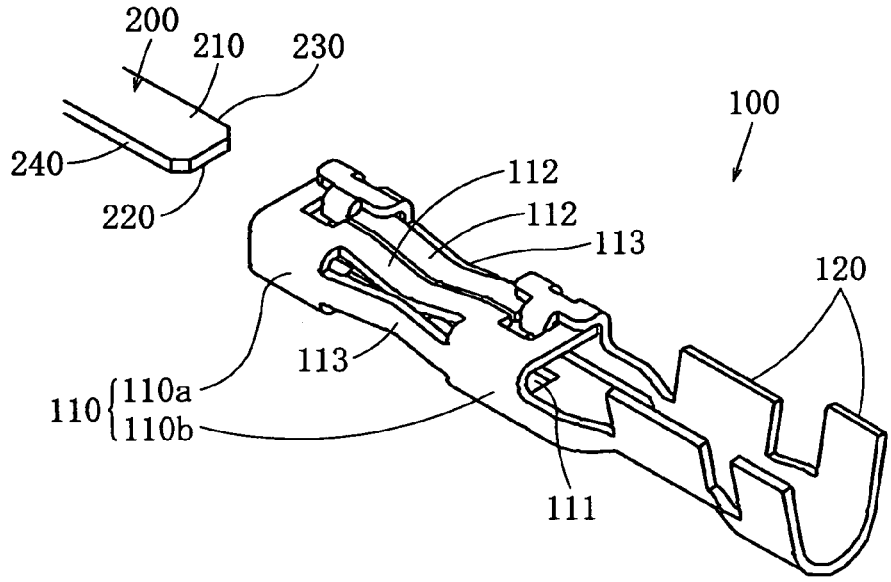
FIG. 1 is a perspective view showing the female terminal for heavy current of the first embodiment together with a blade of a male terminal.
Figure 2:
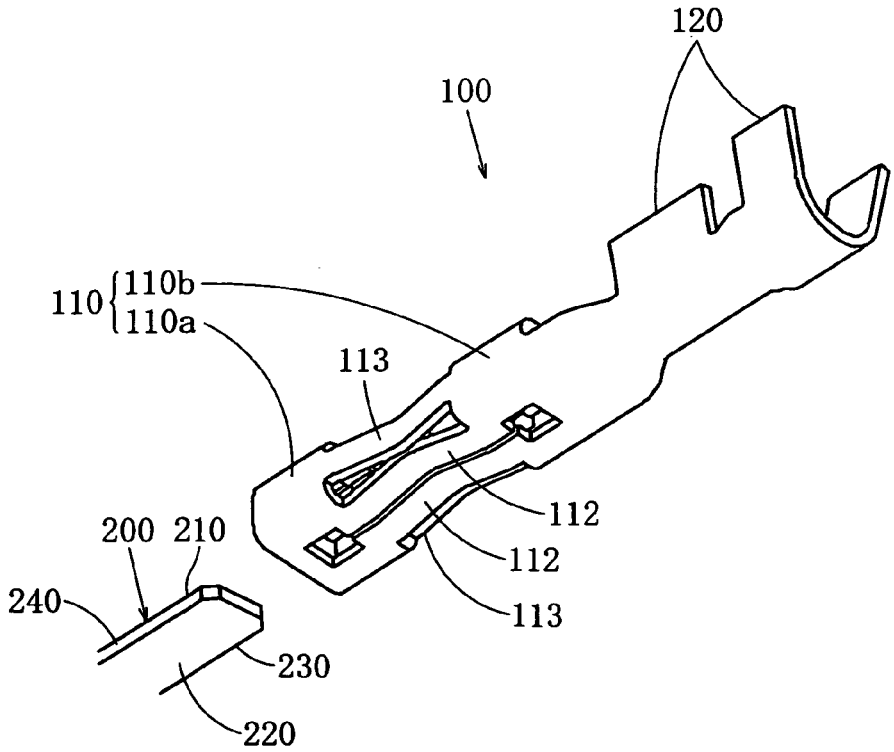
FIG. 2 is a perspective view showing the female terminal for heavy current of the first embodiment together with the blade of the male terminal. It is seen from an angle that differs from that of FIG. 1.
Figure 3:
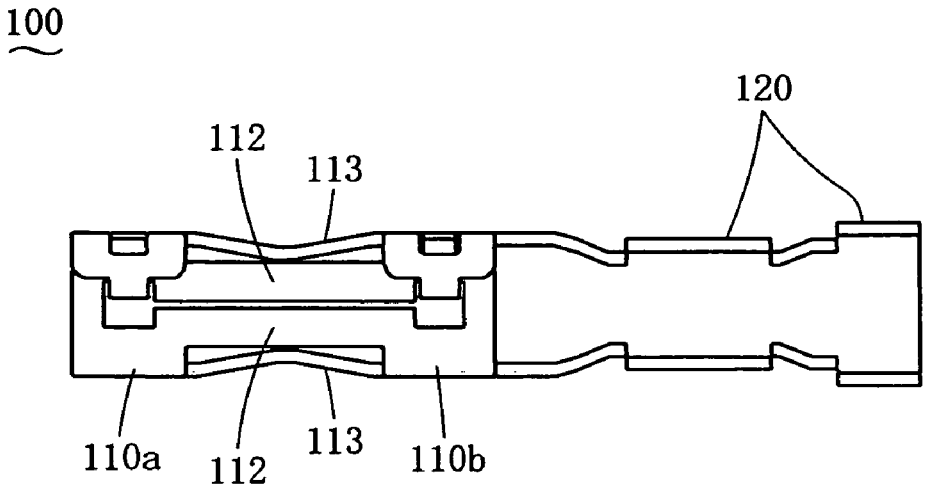
FIG. 3 is a top plan view of the female terminal for heavy current of the first embodiment seen from the top in the height direction.
Figure 4:
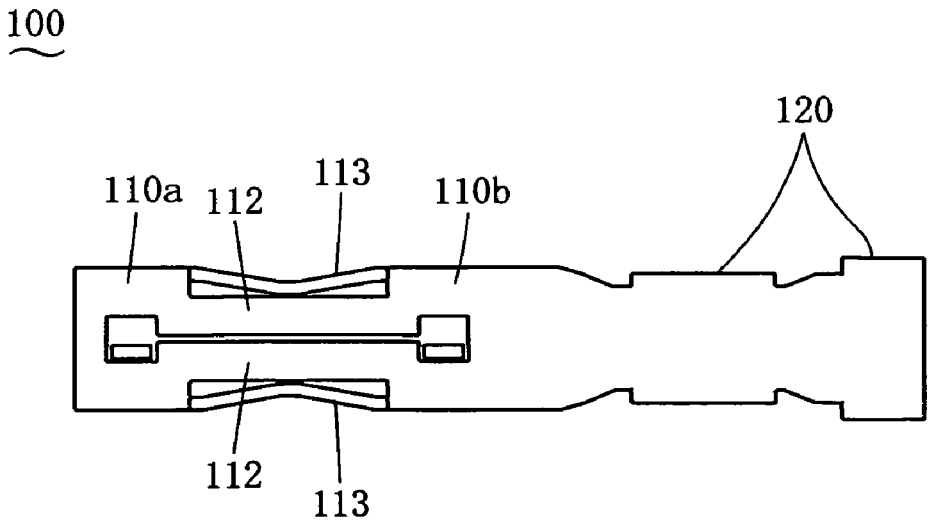
FIG. 4 is a bottom plan view of the female terminal for heavy current of the first embodiment seen from the bottom in the height direction.
Figure 5:
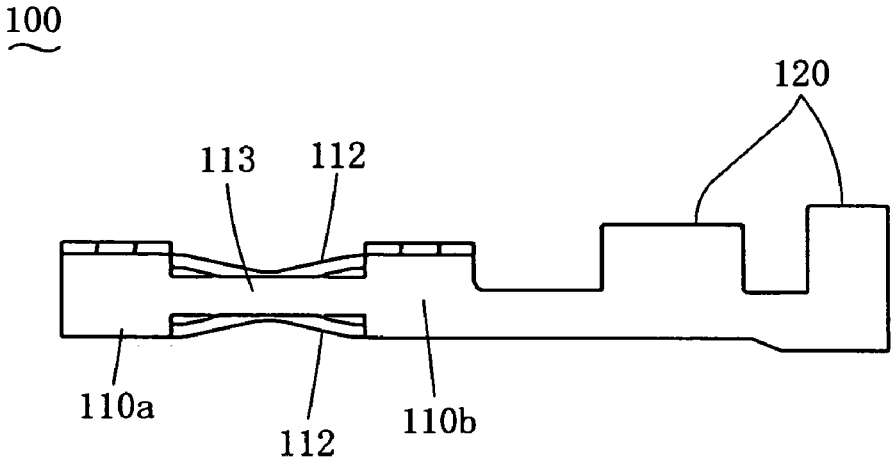
FIG. 5 is a side view of the female terminal for heavy current of the first embodiment seen from one side in the width direction.
Figure 6:
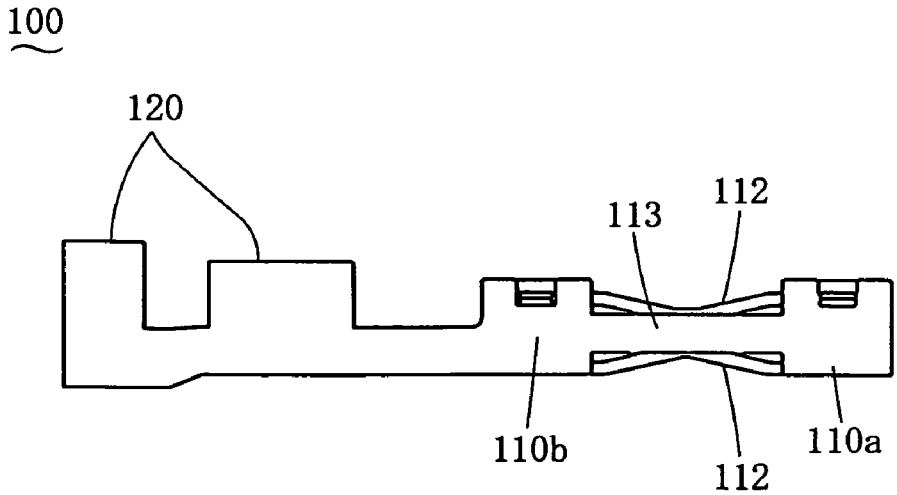
FIG. 6 is a side view of the female terminal for heavy current of the first embodiment seen from the other side in the width direction.
Figure 7:
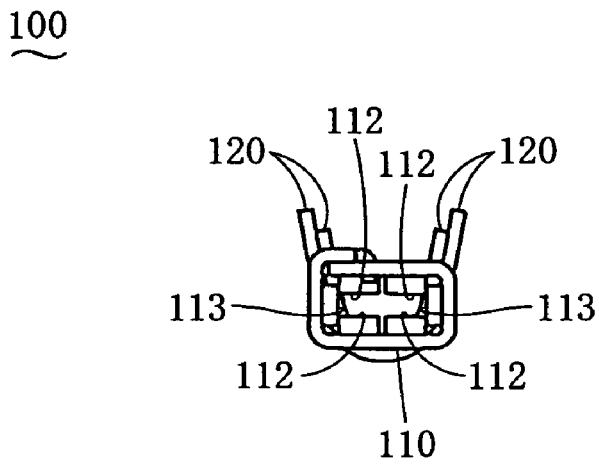
FIG. 7 is a rear view of the female terminal for heavy current of the first embodiment seen from the rear in the depth direction.
Figure 8:
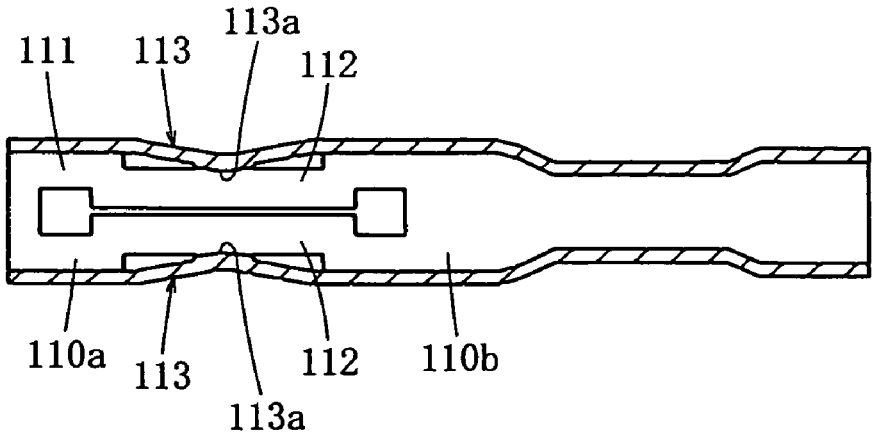
FIG. 8 is a sectional view of the female terminal for heavy current of the first embodiment sectioned in a plane facing in the height direction and seen from the top in the height direction.
Figure 9:
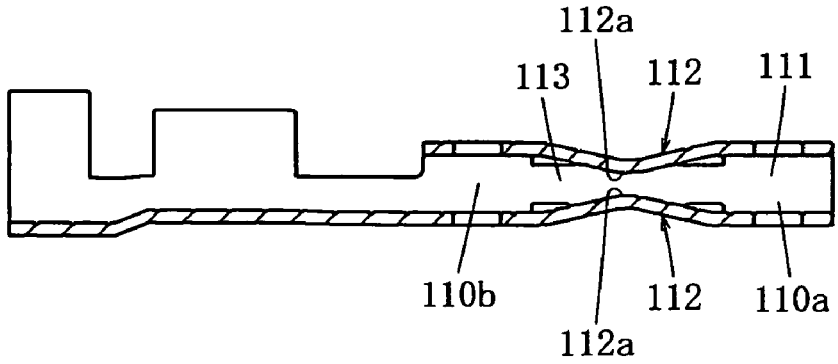
FIG. 9 is a sectional view of the female terminal for heavy current of the first embodiment sectioned in a plane facing in the width direction and seen from one side in the width direction.
Figure 10:
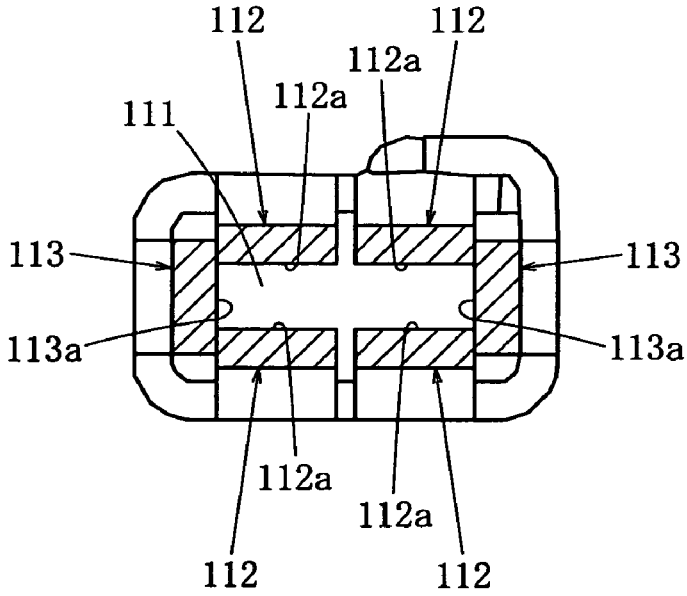
FIG. 10 is an enlarged sectional view of the female terminal for heavy current of the first embodiment sectioned in a plane facing in the depth direction and seen from the front in the depth direction.

As shown in FIG. 1, a blade 200 of a blade-type male terminal (its body is not illustrated) is inserted into and withdrawn from this female terminal for heavy current 100. This blade 200 is formed into a substantially plate form that has a width greater than its height and extends frontward from the rear in the depth direction. The female terminal for heavy current 100 is made of a conductive material. The female terminal for heavy current 100 comprises a body part 110 being made into a tubular form extending in the depth direction and having inside thereof a receiving space 111 for receiving the blade 200 from the rear side, and a connecting part 120, which is provided on the front in the depth direction of the body part 110 and to which a conductor is to be connected. In the case of this embodiment, the conductor is a wire, and the connecting part 120 is provided with an insulation barrel that is to grip the insulation of the wire to make crimp connection and a wire barrel that is to grip the conductor of the wire to make crimp connection, but another example of the connecting part is one with an insulation displacement slot, which will break the insulation of the wire and make connection with the conductor when the wire is pressed into the slot. The conductor is not limited to wires, and it may be, for example, a conductor of an FFC (flexible flat cable), and in that case, the connecting part may be provided with, for example, a projecting part for piercing.

The body part 110 is provided with a first elastic piece 112 at least on one side in the height direction of the receiving space 111 in such a way that the first elastic piece 112 can undergo elastic deformation in the height direction. The first elastic piece 112 is provided, on the inner face thereof, with a contacting part 112*a* extending for a certain width. The inner face means a face that is on the side for contacting the blade 200 when the blade 200 is inserted into the body part 110. The certain width means the same dimension as the width of the first elastic piece 112 or a shorter dimension than that. The first elastic piece 112 is formed into a plate shape, which is substantially formed into a rectangle having a shorter side extending in the width direction and a longer side extending in the depth direction when seen in the height direction and has a thickness in the height direction, but the configuration of the first elastic piece of the present invention is not limited by that. The length in the depth direction of the contacting part 112*a* is set as one thinks fit. Moreover, the body part 110 is provided with a second elastic piece 113 at least on one side in the width direction of the receiving space 111 in such a way that the second elastic piece 113 can undergo elastic deformation in the width direction. The second elastic piece 113 is provided, on its inner face, with a contacting part 113*a* extending for a certain height. The inner face means the face on the side for contacting the blade 200 when the blade 200 is inserted into the body part 110. The certain height means the same dimension as the height of the second elastic piece 113 or a shorter dimension than that. The second elastic piece 113 is formed into a plate shape, which is substantially formed into a rectangle having a shorter side extending in the height direction and a longer side extending in the depth direction when seen in the width direction and has a thickness in the width direction, but the configuration of the second elastic piece of the present invention is not limited by that. The length in the depth direction of the contacting part 113*a* is set as one thinks fit. They are so structured that when the blade 200 is inserted into the receiving space 111, the contacting part 112*a* of the first elastic piece 112 will contact, with a contact pressure, one end face 210 in the height direction of the blade 200, and the contacting part 113*a* of the second elastic piece 113 will contact, with a contact pressure, one end face 230 in the width direction of the blade 200.

The body part 110 is provided with another first elastic piece 112 on the other side in the height direction of the receiving space 111 in such a way that the first elastic piece 112 can undergo elastic deformation in the height direction. The first elastic piece 112 is provided, on the inner face thereof, with a contacting part 112*a* extending for a certain width. And they are so structured that when the blade 200 is inserted into the receiving space 111, the contacting part 112*a* of this first elastic piece 112 will contact, with a contact pressure, the other end face 220 in the height direction of the blade 200. The meanings of the inner face and the certain width are just as described above.

The body part 110 is provided with another second elastic piece 113 on the other side in the width direction of the receiving space 111 in such a way that the second elastic piece 113 can undergo elastic deformation in the width direction. The second elastic piece 113 is provided, on the inner face thereof, with a contacting part 113*a* extending for a certain height. And they are so structured that when the blade 200 is inserted into the receiving space 111, the contacting part 113*a* of this second elastic piece 113 will contact, with a contact pressure, the other end face 240 in the width direction of the blade 200. The meanings of the inner face and the certain height are just as described above.

The body part 110 is divided into a rear end part 110*a* being located at the rear end in the depth direction and a front end part 110*b* being located at the front end. Rear-end-part-constituting walls that constitute the rear end part 110*a* and front-end-part-constituting walls that constitute the front end part 110*b* are interconnected to each other by the first elastic pieces 112, the second elastic pieces 113 or both the elastic pieces 112, 113. The elastic pieces 112, 113 that interconnect both the rear-end-part-constituting walls and the front-end-part-constituting walls are bent in such a way that their intermediate parts get closer toward the receiving space 111, and the contacting parts 112*a*, 113*a* are provided on these bending parts.

Figure 12:
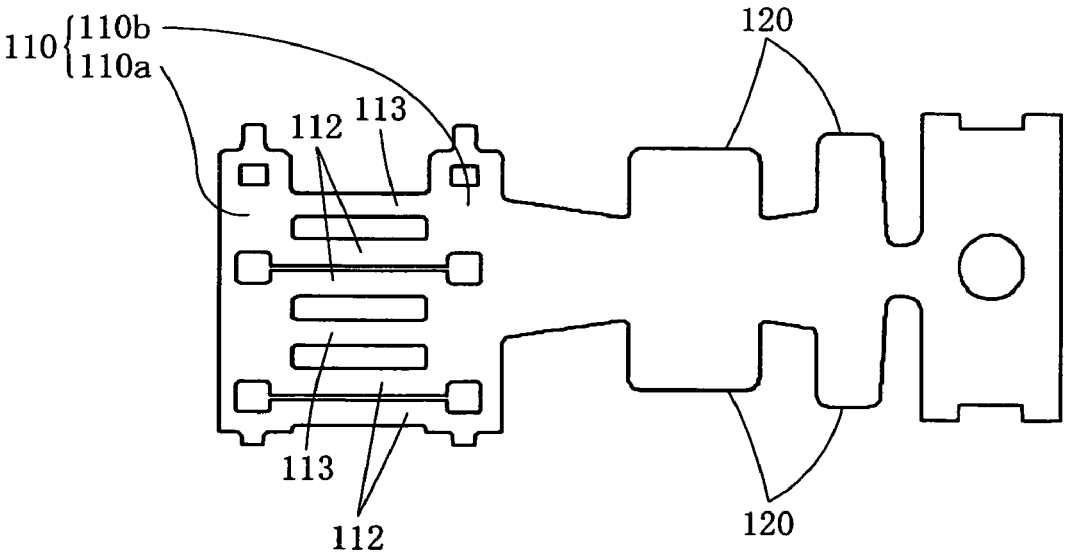
FIG. 12 is a reduced plan view of the blank of the female terminal for heavy current of the first embodiment. The blank is not separated from the bar.

A plurality of the first elastic pieces 112 are provided side by side in the width direction. The female terminal for heavy current 100 is formed by bending a single blank that is formed into a certain configuration as shown in FIG. 12. The female terminal for heavy current of the present invention, however, may be structured with a plurality of members, and its structure and structuring method are not limited by this embodiment.

Figure 11:
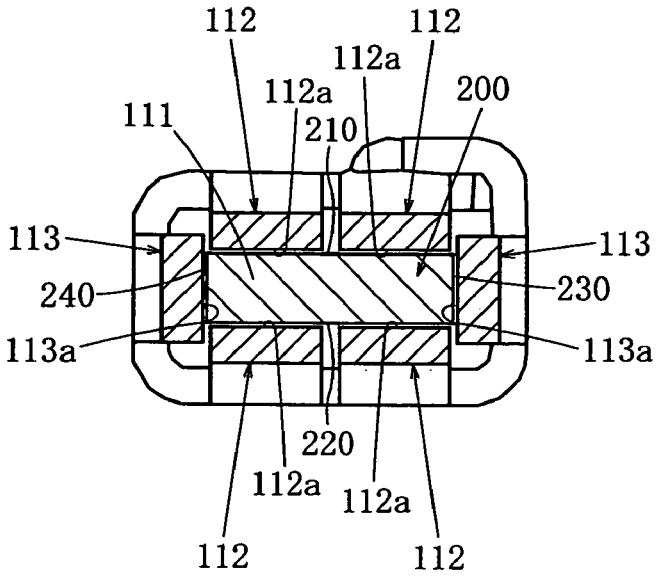
FIG. 11 is an enlarged sectional view of the female terminal for heavy current of the first embodiment with a blade inserted therein, sectioned in a plane facing in the depth direction and seen from the front in the depth direction.

Next, the functions and effects of the female terminal for heavy current 100 of the first embodiment will be described. As shown in FIG. 11, when the blade 200 is inserted into the receiving space 111, the contacting part 112*a* of the first elastic piece 112 will contact, with a contact pressure, one end face 210 in the height direction of the blade 200, and a part of the body part 110 facing the receiving space 111 will contact, with a contact pressure, the other end face 220 in the height direction of the blade 200. Moreover, the contacting part 113*a* of the second elastic piece 113 will contact, with a contact pressure, one end face 230 in the width direction of the blade 200, and a part of the body part 110 facing the receiving space 111 will contact, with a contact pressure, the other end face 240 in the width direction of the blade 200. In that case, the female terminal for heavy current 100 contacts the blade 200 at a plurality of points including the contacting part 112*a* of the first elastic piece 112 and the contacting part 113*a* of the second elastic piece 113. Moreover, as these contacting parts 112*a*, 113*a* contact the blade 200 by line contact or surface contact rather than point contact, a larger contact area is obtained. Furthermore, due to elastic restoring forces of the elastic pieces 112, 113, higher contact pressures are obtained at the contacting parts 112*a*, 113*a*. Accordingly, the contact resistance between the female terminal for heavy current 100 and the male terminal is reduced reliably, and a heavy current flows stably at a low loss between both the terminals. As the blade 200 is held by the first elastic piece 112 and the opposite part of the body part 110 facing the receiving space 111, and the blade 200 is also held by the second elastic piece 113 and the opposite part of the body part 110 facing the receiving space 111, the positioning of the blade 200 in the receiving space 111 is done with precision.

The present invention includes an embodiment wherein the body part is provided, only on one side in the height direction of the receiving space, with the first elastic piece that is arranged in such a way that it can undergo elastic deformation in the height direction and is provided, on the inner face, with a contacting part extending for a certain width. In contrast to it, in the case of the first embodiment, the body part 110 is provided, on the other end in the height direction of the receiving space 111, with another first elastic piece 112 that is arranged in such a way that it can undergo elastic deformation in the height direction and is provided, on the inner side, with a contacting part 112*a* extending for a certain width, and they are so structured that when the blade 200 is inserted into the receiving space 111, the contacting part 112*a* of this first elastic piece 112 will contact, with a contact pressure, the end face 220 on the other end in the height direction of the blade 200. With this arrangement, when the blade 200 is inserted into the receiving space 111, the contacting parts 112*a* of the first elastic pieces 112 will contact, with a contact pressure, both end faces 210, 220 in the height direction of the blade 200. Hence the amounts of elastic deformation of the first elastic pieces 112 can be kept relatively small.

The present invention includes an embodiment wherein the body part is provided, only on one side in the width direction of the receiving space, with the second elastic piece that is arranged in such a way that it can undergo elastic deformation in the width direction and is provided, on the inner face, with a contacting part extending for a certain height. In contrast to it, in the case of the first embodiment, the body part 110 is provided, on the other end in the width direction of the receiving space 111, with another second elastic piece 113 that is arranged in such a way that it can undergo elastic deformation in the width direction and is provided, on the inner face, with a contacting part 113*a* extending for a certain height, and they are so structured that when the blade 200 is inserted into the receiving space 111, the contacting part 113*a* of this second elastic piece 113 will contact, with a contact pressure, the end face 240 on the other end in the width direction of the blade 200. With this arrangement, when the blade 200 is inserted into the receiving space 111, the contacting parts 113*a* of the second elastic pieces 113 will contact, with a contact pressure, both the end faces 230, 240 in the width direction of the blade 200. Hence the amounts of elastic deformation of the second elastic pieces 113 can be kept relatively small.

The present invention includes an embodiment wherein the body part is not divided into front and rear parts but instead is provided integrally and the first elastic piece, the second elastic piece or both the elastic pieces are provided inside the body part. In contrast to it, in the case of the first embodiment, the body part 110 is divided into the rear end part 110*a* being located at the rear end in the depth direction and the front end part 110*b* being located at the front end, wherein rear-end-part-constituting walls constituting the rear end part 110*a* and front-end-part-constituting walls constituting the front end part 110*b* are interconnected to each other by the first elastic pieces 112, the second elastic pieces 113 or both the elastic pieces 112, 113, and the elastic pieces 112, 113 interconnecting both the rear-end-part-constituting walls and the front-end-part-constituting walls are so bent that respective intermediate parts thereof get closer toward the receiving space 111, and the contacting parts 112*a*, 113*a* are provided on these bent parts. With this arrangement, as the first elastic piece 112 and the second elastic piece 113 are supported on both ends by the body part 110, the contact pressures that can be obtained at the contacting parts 112*a*, 113*a* are higher in comparison with, for example, a cantilever elastic piece that is supported on only one end by the main body, assuming the lengths in the depth direction of the elastic pieces are substantially equal. Moreover, as the rear-end-part-constituting walls, the first elastic piece 112 or the second elastic piece 113 or both the elastic pieces, and the front-end-part-constituting walls are continuous without any break, insertion and withdrawal of the blade 200 is done smoothly without any hitch. Furthermore, as there is no constituting wall of the body part 110 on the outer side of the first elastic piece 112, the second elastic piece 113 or both the elastic pieces, the height or the width or both the height and width of the female terminal for heavy current 100 can be reduced.

The present invention includes an embodiment wherein a single first elastic piece is provided on one side in the height direction of the receiving space, and an embodiment wherein a single first elastic piece is provided on each of both sides in the height direction of the receiving space. In contrast with them, in the case of the first embodiment, a plurality of the first elastic pieces 112 are provided side by side in the width direction. With this arrangement, even when the end faces 210, 220 in the height direction of the blade 200 slant a little in the width direction, the contacting parts 112*a* of a plurality of the first elastic pieces 112 will follow this slant to adequately contact the end faces 210, 220 of the blade 200 and the state of contact will be stabilized.

Next, other embodiments of the female terminal for heavy current of the present invention will be described. When the structure of an embodiment is similar to that of the first embodiment, the same reference characters will be used and a redundant description thereof will be omitted. Different structures will be described. FIG. 13 through FIG. 17 show a female terminal for heavy current with a shell, being the second embodiment. This female terminal for heavy current with a shell comprises the female terminal for heavy current 100 of the first embodiment and a tubular shell 300 that extends in the depth direction and fits with the body part 110 from the outside. This shell 300 is provided with projections 310, which rise from parts corresponding to the bent parts of the first elastic pieces 112 and the bent parts of the second elastic pieces 113 toward these bent parts, and these projections 310 prevent the first elastic pieces 112 and the second elastic pieces 113 from excessive deformation.

Figure 13:
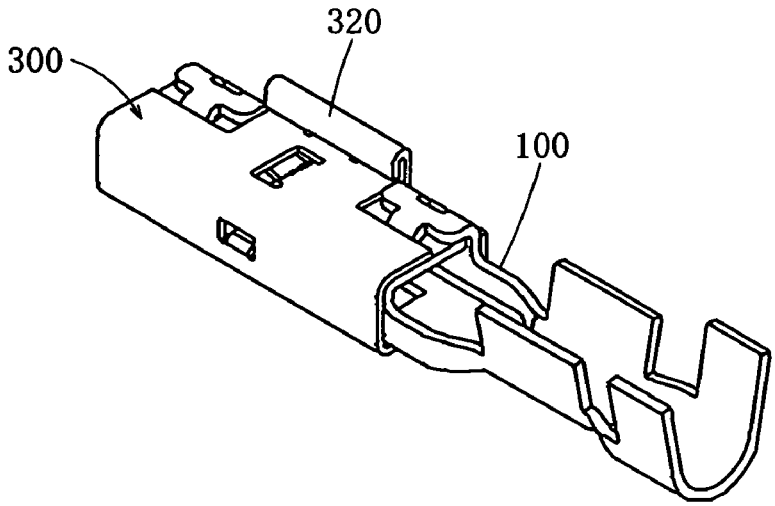
FIG. 13 is a perspective view of the female terminal for heavy current with a shell of the second embodiment.
Figure 14:
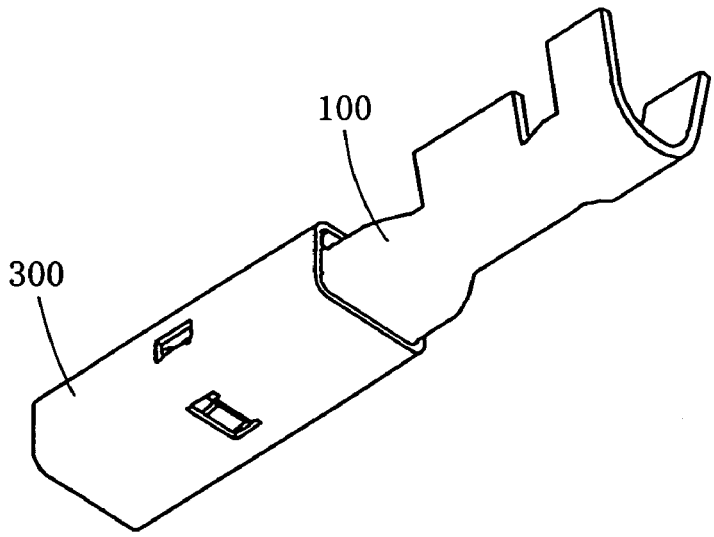
FIG. 14 is a perspective view of the female terminal for heavy current with a shell of the second embodiment. It is seen from an angle that differs from that of FIG. 13.
Figure 15:
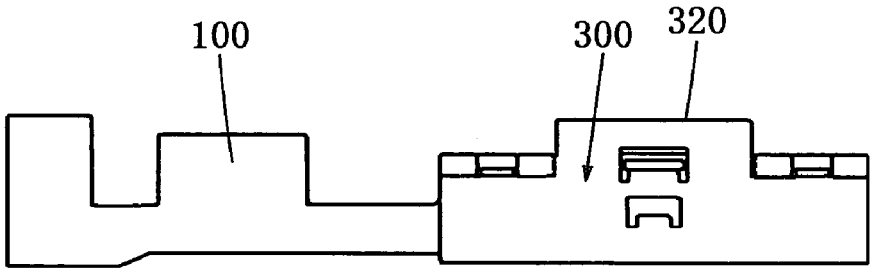
FIG. 15 is a side view of the female terminal for heavy current with a shell of the second embodiment seen from one side in the width direction.
Figure 16:
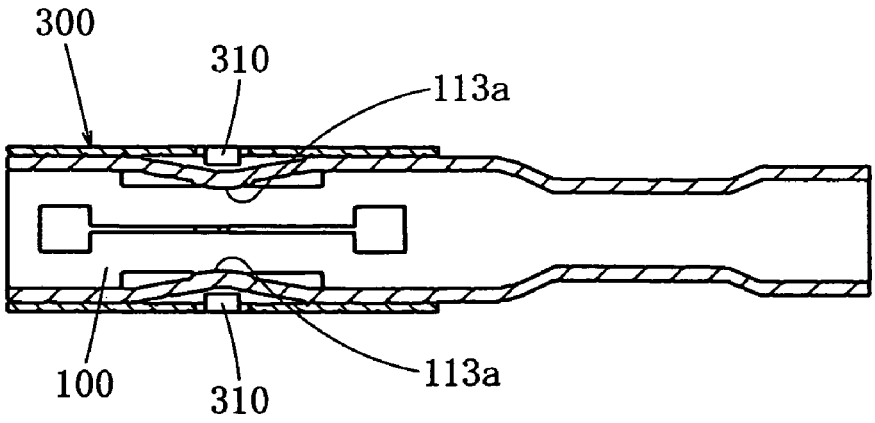
FIG. 16 is a sectional view of the female terminal for heavy current with a shell of the second embodiment sectioned in a plane facing in the height direction and seen from the top in the height direction.
Figure 17:
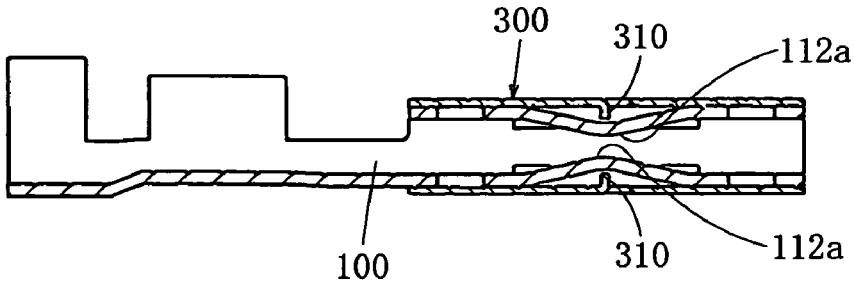
FIG. 17 is a sectional view of the female terminal for heavy current with a shell of the second embodiment sectioned in a plane facing in the width direction and seen from one side in the width direction.

This female terminal for heavy current with a shell provides functions and effects that are similar to those obtained from the first embodiment. This female terminal for heavy current with a shell contacts the blade 200 with a large contact area and a high contact pressure. In that case, as the female terminal for heavy current 100 is restrained from deforming by the shell 300, the first elastic pieces 112 and the second elastic pieces 113 exhibit their expected functions and the contacting parts 112*a*, 113*a* contact the blade 200 with a high contact pressure. When the first elastic pieces 112 and the second elastic pieces 113 undergo excessive deformation, the shell 300 will restrain them and prevent the first elastic pieces 112 and the second elastic pieces 113 from suffering plastic deformation and breakage. Moreover, the shell protects the first elastic pieces 112 and the second elastic pieces 113 inside the shell from external forces. As shown in FIG. 13 and FIG. 15, if the shell 300 is provided with, for example, a projecting piece 320 rising outward and a housing (not illustrated) is provided with a receiving chamber for receiving the female terminal for heavy current with a shell and a guiding groove for guiding the projecting piece 320, at the time of inserting the female terminal for heavy current with a shell into the housing, functions of preventing reverse insertion wherein it is inserted in a wrong orientation in the height direction or the depth direction into the housing and incorrect insertion wherein it is inserted into a housing that is not a genuine counterpart member are exhibited. In that case, when such functions are required, such requirements can be met by designing or selecting a shell 300 that fits with the female terminal for heavy current without any design change of the female terminal for heavy current itself.

Figure 18:
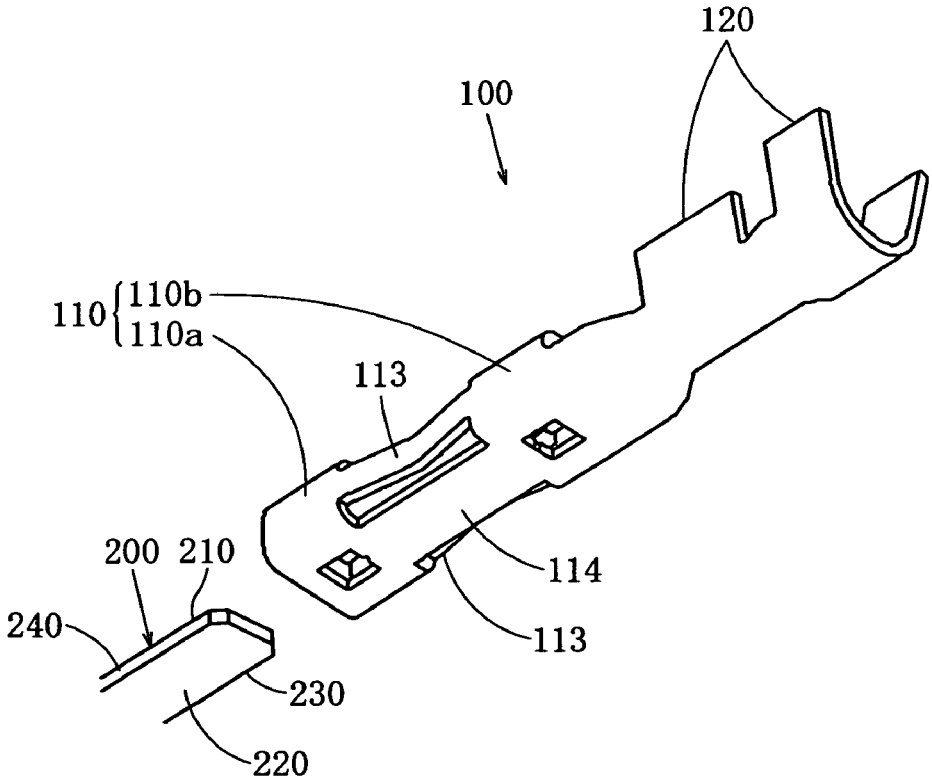
FIG. 18 is a perspective view showing the female terminal for heavy current of the third embodiment with a blade of a male terminal.
Figure 19:
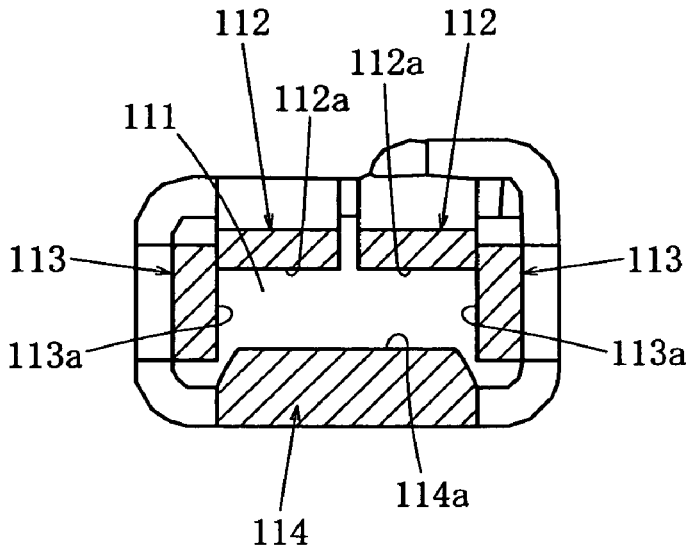
FIG. 19 is an enlarged sectional view of the female terminal for heavy current of the third embodiment sectioned in a plane facing in the depth direction and seen from the front in the depth direction.
Figure 20:
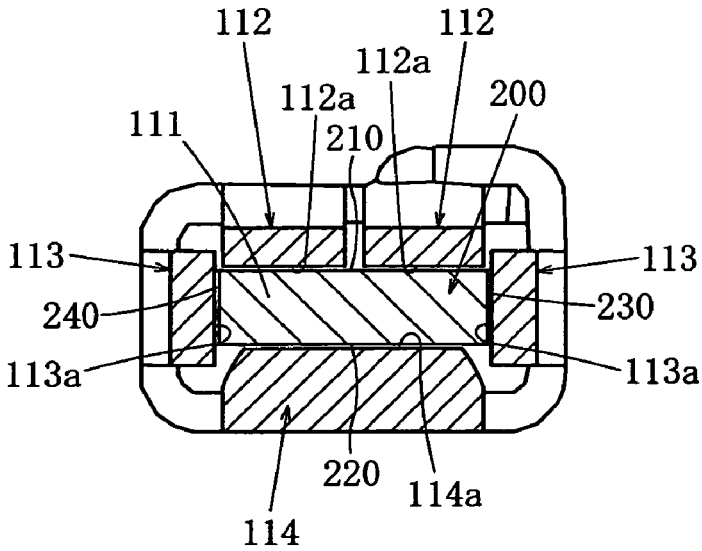
FIG. 20 is an enlarged sectional view of the female terminal for heavy current of the third embodiment into which a blade is inserted. They are sectioned in a plane facing in the depth direction and seen from the front in the depth direction.

FIG. 18 through FIG. 20 show a female terminal for heavy current 100 being the third embodiment. In the case of the female terminal for heavy current 100 of the first embodiment, the body part 110 is provided, on the other side in the height direction of the receiving space 111, with another first elastic piece 112 that is provided in such a way that it can undergo elastic deformation in the height direction and is provided with a contacting part 112*a* extending for a certain width. In contrast to that, in the case of the third embodiment, the body part 110 is provided, on the other side in the height direction of the receiving space 111, with a cross wall 114 that is provided, on the inner face thereof, with a contacting part 114*a* extending for a certain width, and they are so structured that when the blade 200 is inserted into the receiving space 111, the contacting part 114*a* of the cross wall 114 will contact, with a contact pressure, the end face on the other side in the height direction of the blade 200. The inner face means a face that is on the side for contacting the blade 200 when the blade 200 is inserted into the body part 110. The contacting part 114*a* may be formed by a portion of the inner face of the plate-shaped cross wall 114, however, to define the contact point by increasing the contact pressure, it is preferable to make the contacting part 114*a* protrude toward the receiving space 111. The length in the depth direction of the contacting part 114*a* is set as one thinks fit.

In the case of the female terminal for heavy current 100 of the third embodiment, as shown in FIG. 20, when the blade 200 is inserted into the receiving space 111, the contacting part 112*a* of the first elastic piece 112 will contact, with a contact pressure, one end face 210 in the height direction of the blade 200, and the contacting part 114*a* of the cross wall 114 of the body part 110 will contact, with a contact pressure, the other end face 220 in the height direction of the blade 200. This female terminal for heavy current 100 provides functions and effects that are similar to those obtained in the first embodiment, and as the first elastic piece 112 is provided only on one side in the height direction of the receiving space 111, the structure is relatively simple.

Figure 21:
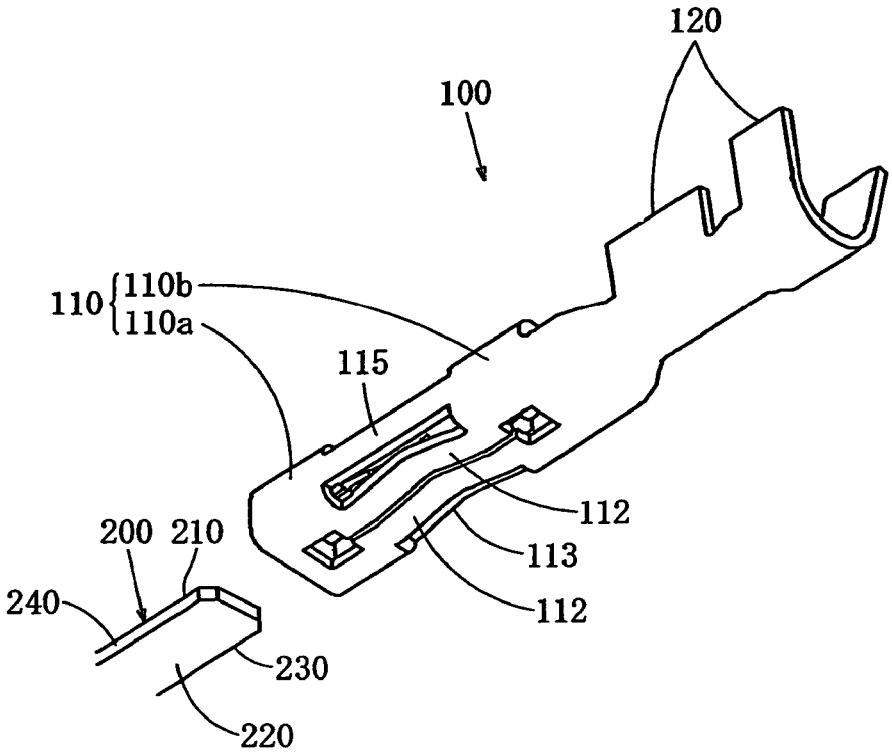
FIG. 21 is a perspective view showing the female terminal for heavy current of the fourth embodiment with a blade of a male terminal.
Figure 22:
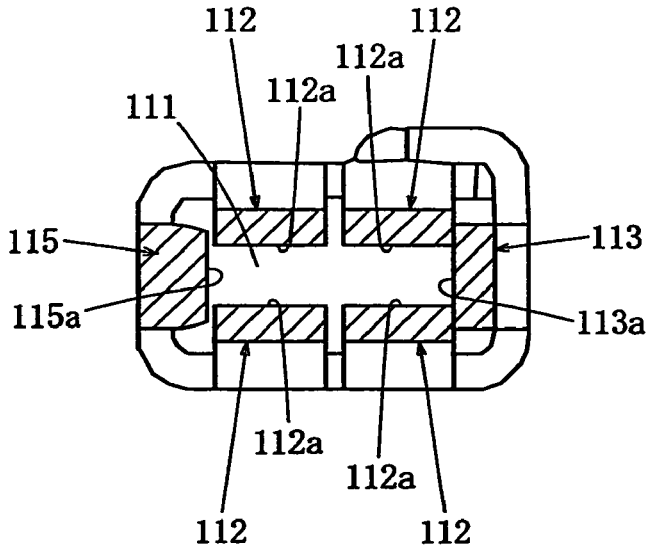
FIG. 22 is an enlarged sectional view of the female terminal for heavy current of the fourth embodiment sectioned in a plane facing in the depth direction and seen from the front in the depth direction.
Figure 23:
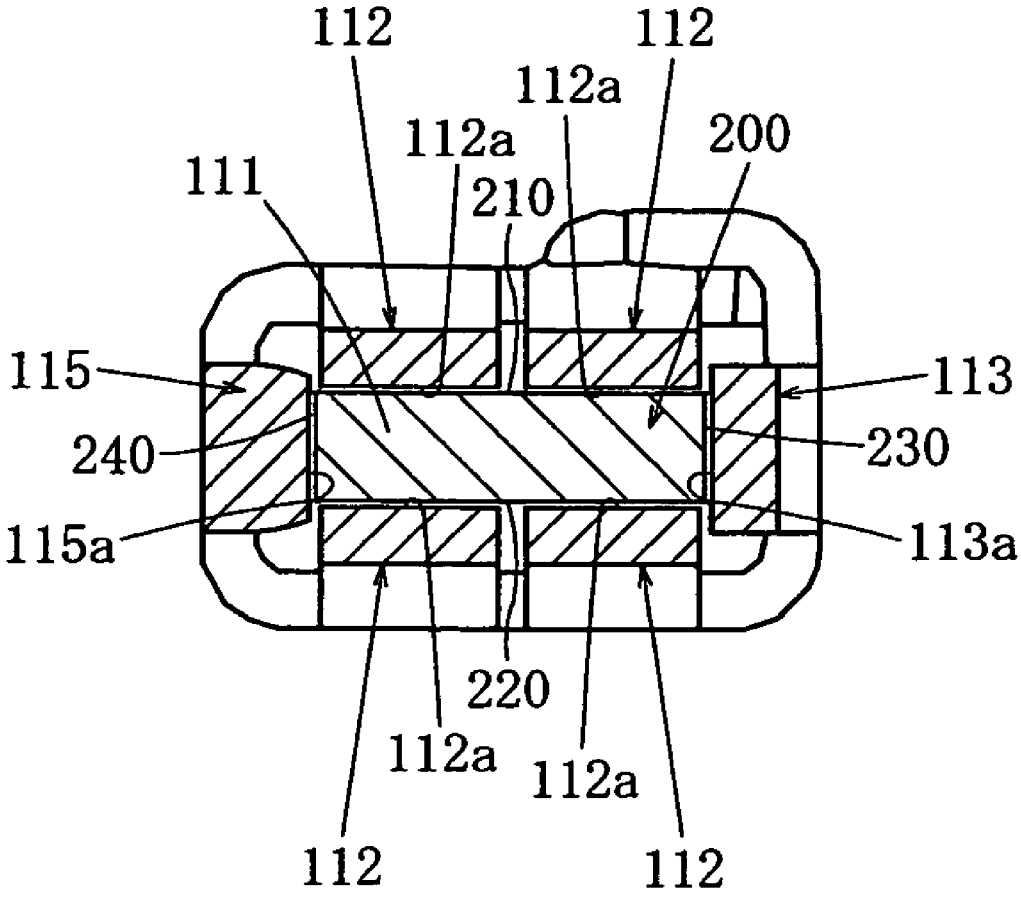
FIG. 23 is an enlarged sectional view of the female terminal for heavy current of the fourth embodiment into which a blade is inserted. They are sectioned in a plane facing in the depth direction and seen from the front in the depth direction.

FIG. 21 through FIG. 23 show a female terminal for heavy current 100 being the fourth embodiment. In the case of the fourth embodiment, the body part 110 is provided, on the other side in the width direction of the receiving space 111, with a vertical wall 115 that is provided, on the inner face, with a contacting part 115*a* extending for a certain height, and they are so structured that when the blade 200 is inserted into the receiving space 111, the contacting part 115*a* of the vertical wall 115 will contact, with a contact pressure, the end wall 240 on the other side in the width direction of the blade 200. The inner face means a face that is on the side for contacting the blade 200 when the blade 200 is inserted into the body part 110. The contacting part 115*a* may be formed by a portion of the inner face of the plate-shaped vertical wall 115, however, to define the contact point by increasing the contact pressure, it is preferable to make the contacting part 115*a* protrude toward the receiving space 111. The length in the depth direction of the contacting part 115*a* is set as one thinks fit.

In the case of the female terminal for heavy current 100 of the fourth embodiment, as shown in FIG. 23, when the blade 200 is inserted into the receiving space 111, the contacting part 113*a* of the second elastic piece 113 will contact, with a contact pressure, the end face 230 on one side in the width direction of the blade 200, and the contacting part 115*a* of the vertical wall 115 of the body part 110 will contact, with a contact pressure, the other end face 240 in the width direction of the blade 200. This female terminal for heavy current 100 provides functions and effects that are similar to those obtained in the first embodiment, and as the second elastic piece 113 is provided only on one side in the width direction of the receiving space 111, the structure is relatively simple.

In the above-mentioned embodiments, the body part 110 is staggered from the first elastic piece 112 and the second elastic piece 113 in the depth direction, but the first elastic piece, the second elastic piece or both the elastic pieces may be provided in the body part. In the above-mentioned embodiments, the first elastic piece 112 and the second elastic piece 113 are interconnected to the body part 110 on both the rear end and the front end thereof, however, one end of the elastic piece is interconnected to the body part and the other end may be left as a free end. Moreover, well-known structures of elastic pieces of a female terminal, such as providing an elastic piece with a U-shaped bending part, may be adopted. In the above-mentioned embodiments, the elastic pieces 112, 113 are provided with bending parts in the middle and these bending parts were provided with contacting parts 112*a*, 113*a*, respectively. However, one elastic piece may be provided with a plurality of bending parts in the depth direction, and these bending parts may be provided with contacting parts, respectively. The certain width and the certain height are dimensions that are determined freely as the length of a contacting part on the first elastic piece, the second elastic piece, the cross wall and the vertical wall, respectively, and identical expressions do not mean identical dimensions.

The present invention includes embodiments wherein features of the above-mentioned embodiments are combined.

What is claimed is:

1. A female terminal for heavy current, with reference to a depth direction, a width direction and a height direction being perpendicular to each other, into which and from which a blade of a blade-type male terminal having a substantially plate-shaped blade having a width greater than a height thereof and extending frontward in the depth direction is inserted and withdrawn, said female terminal comprising a body part being of a tubular form extending in the depth direction and being provided therein with a receiving space for receiving the blade from a rear side in the depth direction, said female terminal further comprising a connecting part being provided at a front in the depth direction of the body part and being adapted to be connected with a conductor, said body part having a first elastic piece being provided at least on one side in the height direction of the receiving space such that the first elastic piece can undergo elastic deformation in the height direction and being provided, on an inner face thereof, with a first contacting part extending for a certain width, said body part further having a second elastic piece being provided at least on one side in the width direction of the receiving space such that the second elastic piece can undergo elastic deformation in the width direction and being provided, on an inner face thereof, with a second contacting part extending for a certain height, said female terminal for heavy current being so structured that upon insertion of the blade into the receiving space the first contacting part of the first elastic piece will contact, with a contact pressure, a first end face in the height direction of the blade and the second contacting part of the second elastic piece will contact, with a contact pressure, a second end face in the width direction of the blade, said first and second elastic pieces being so configured and arranged such that both said first contacting part will contact said first end face and said second contacting part will contact said second end face on a single common contact plane extending normal to the depth direction, and said body part including a tubular front end part at a front end of said body part and a tubular rear end part at a rear end of said body part, and said front end part and said rear end part being connected to each other by said first elastic piece and by said second elastic piece respectively extending continuously and integrally therebetween.

2. The female terminal for heavy current as recited in claim 1, being so structured that the body part is provided with a flat unbent cross wall on the other side in the height direction of the receiving space, said cross wall being less flexible than said first elastic piece and being provided, on an inner face thereof, with a contacting part extending for a certain width, and upon insertion of the blade into the receiving space, the contacting part of the cross wall will contact, with a contact pressure, the other end face in the height direction of the blade.

3. The female terminal for heavy current as recited in claim 1, being so structured that the body part has another first elastic piece being provided on the other side in the height direction of the receiving space such that the another first elastic piece can undergo elastic deformation in the height direction and being provided, on an inner face thereof, with a contacting part extending for a certain width, and upon insertion of the blade into the receiving space the contacting part of the another first elastic piece will contact, with a contact pressure, the other end face in the height direction of the blade.

4. The female terminal for heavy current as recited in claim 2, being so structured that the body part is provided with a flat unbent vertical wall on the other side in the width direction of the receiving space, said vertical wall being less flexible than said second elastic piece and being provided, on an inner face thereof, with a contacting part extending for a certain height, and upon insertion of the blade into the receiving space, the contacting part of the vertical wall will contact, with a contact pressure, the other end face in the width direction of the blade.

5. The female terminal for heavy current as recited in claim 3, being so structured that the body part is provided with a flat unbent vertical wall on the other side in the width direction of the receiving space, said vertical wall being less flexible than said second elastic piece and being provided, on an inner face thereof, with a contacting part extending for a certain height, and upon insertion of the blade into the receiving space, the contacting part of the vertical wall will contact, with a contact pressure, the other end face in the width direction of the blade.

6. The female terminal for heavy current as recited in claim 2, being so structured that the body part has another second elastic piece being provided on the other side in the width direction of the receiving space such that the another second elastic piece can undergo elastic deformation in the width direction and being provided, on an inner face thereof, with a contacting part extending for a certain height, and upon insertion of the blade into the receiving space, the contacting part of the another second elastic piece will contact, with a contact pressure, the other end face in the width direction of the blade.

7. The female terminal for heavy current as recited in claim 3, being so structured that the body part has another second elastic piece being provided on the other side in the width direction of the receiving space such that the another second elastic piece can undergo elastic deformation in the width direction and being provided, on an inner face thereof, with a contacting part extending for a certain height, and upon insertion of the blade into the receiving space, the contacting part of the another second elastic piece will contact, with a contact pressure, the other end face in the width direction of the blade.

8. The female terminal for heavy current as recited in claim 2, wherein the first and second elastic pieces are so bent that an intermediate bent part thereof bends closer toward the receiving space, and the respective contacting part thereof is provided on the inner face of the intermediate bent part thereof respectively.

9. The female terminal for heavy current as recited in claim 3, wherein the first and second elastic pieces are so bent that an intermediate bent part thereof bends closer toward the receiving space, and the respective contacting part thereof is provided on the inner face of the intermediate bent part thereof respectively.

10. The female terminal for heavy current as recited in claim 4, wherein the first and second elastic pieces are so bent that an intermediate bent part thereof bends closer toward the receiving space, and the respective contacting part thereof is provided on the inner face of the intermediate bent part thereof respectively.

11. The female terminal for heavy current as recited in claim 6, wherein the first and second elastic pieces are so bent that an intermediate bent part thereof bends closer toward the receiving space, and the respective contacting part thereof is provided on the inner face of the intermediate bent part thereof respectively.

12. The female terminal for heavy current as recited in claim 2, further comprising at least another one of said first elastic piece so as to have a plurality of said first elastic pieces being arranged side by side in the width direction.

13. The female terminal for heavy current as recited in claim 3, further comprising at least another one of said first elastic piece so as to have a plurality of said first elastic pieces being arranged side by side in the width direction.

14. The female terminal for heavy current as recited in claim 4, further comprising at least another one of said first elastic piece so as to have a plurality of said first elastic pieces being arranged side by side in the width direction.

15. The female terminal for heavy current as recited in claim 6, further comprising at least another one of said first elastic piece so as to have a plurality of said first elastic pieces being arranged side by side in the width direction.

16. The female terminal for heavy current as recited in claim 8, further comprising at least another one of said first elastic piece so as to have a plurality of said first elastic pieces being arranged side by side in the width direction.

17. A combination comprising the female terminal for heavy current as recited in claim 2 and a tubular shell extending in the depth direction to fit with the body part of the female terminal from outside.

18. A combination comprising the female terminal for heavy current as recited in claim 3 and a tubular shell extending in the depth direction to fit with the body part of the female terminal from outside.

19. A combination comprising the female terminal for heavy current as recited in claim 4 and a tubular shell extending in the depth direction to fit with the body part of the female terminal from outside.

20. A combination comprising the female terminal for heavy current as recited in claim 6 and a tubular shell extending in the depth direction to fit with the body part of the female terminal from outside.

21. A combination comprising the female terminal for heavy current as recited in claim 8 and a tubular shell extending in the depth direction to fit with the body part of the female terminal from outside.

22. A combination comprising the female terminal for heavy current as recited in claim 12 and a tubular shell extending in the depth direction to fit with the body part of the female terminal from outside.

23. A female electrical terminal adapted to be separably connected to a male terminal blade, said female electrical terminal comprising:

a conductive tubular body that extends in a longitudinal direction and that surrounds a receiving space with an opening at a first end thereof adapted to receive the male terminal blade inserted therein; and a conductive connection part that is connected to and extends in said longitudinal direction from a second end of said tubular body opposite said first end, and that is adapted to be connected to an electrical conductor;

wherein:

said tubular body comprises a tubular first body part at said first end, a tubular second body part at said second end, first and second elastic pieces, and first and second body walls;

said first elastic piece and said first body wall extend in said longitudinal direction from at least one of said body parts in an area between said body parts, and are arranged opposite one another in a first transverse direction perpendicular to said longitudinal direction to bound said receiving space therebetween;

said second elastic piece and said second body wall extend in said longitudinal direction from at least one of said body parts in said area between said body parts, and are arranged opposite one another in a second transverse direction perpendicular to said longitudinal direction and said first transverse direction to bound said receiving space therebetween;

a least one of said first elastic piece and said first body wall, and at least one of said second elastic piece and said second body wall, respectively extend continuously and integrally between and interconnect said first and second body parts;

said first and second elastic pieces have, on inner sides thereof facing said receiving space in said first and second transverse directions respectively, first and second contact portions adapted to contact the male terminal blade in said receiving space, and said first and second elastic pieces are elastically deflectable respectively in said first and second transverse directions; and said first and second elastic contact portions are located on a single common contact plane extending normal to said longitudinal direction.

24. The female electrical terminal according to claim 23, wherein said first and second elastic pieces are respectively bent inwardly into said receiving space in said first and second transverse directions to respectively form said first and second contact portions on first and second inwardly bent peaks of said first and second elastic pieces on said common contact plane intermediately between said first and second body parts.

25. The female electrical terminal according to claim 23, wherein said first and second body walls are respective flat unbent walls that are less flexible than said first and second elastic pieces.

26. The female electrical terminal according to claim 23, wherein said first and second body walls are respective inwardly bent flexible pieces.

27. The female electrical terminal according to claim 23, wherein all of said first and second elastic pieces and said first and second body walls respectively extend continuously and integrally between and interconnect said first and second body parts.

* * * * *